US005472788A

United States Patent [19]

Benitez-Garriga

[11] Patent Number: 5,472,788

[45] Date of Patent: Dec. 5, 1995

[54] COLORED ANODIZED ALUMINUM AND ELECTROLYTIC METHOD FOR THE MANUFCTURE OF SAME

[76] Inventor: Eliseo Benitez-Garriga, Centeno 430, Colonia Granjas Mexico, Mexico D.F. 08400, Mexico

[21] Appl. No.: 274,684

[22] Filed: Jul. 14, 1994

[51] Int. Cl.[6] ..... B32B 9/00; B32B 15/04; C25D 11/12

[52] U.S. Cl. ..... 428/472.2; 205/50; 205/105; 205/106; 205/121; 205/174; 205/175; 205/229; 205/917

[58] Field of Search ..... 205/50, 105, 106, 205/121, 174, 175, 229, 917; 428/472.2

[56] References Cited

U.S. PATENT DOCUMENTS

| | | | |
|---|---|---|---|
| 4,022,671 | 5/1977 | Asada | 205/174 |
| 4,042,468 | 8/1977 | Hasegawa et al. | 205/174 |
| 4,066,816 | 1/1978 | Sheasby et al. | 428/336 |
| 4,152,222 | 5/1979 | Sheasby et al. | 205/174 |
| 4,251,330 | 2/1981 | Sheasby et al. | 204/35 N |
| 4,310,586 | 1/1982 | Sheasby et al. | 205/105 |

*Primary Examiner*—John Niebling
*Assistant Examiner*—Edna Wong
*Attorney, Agent, or Firm*—Sughrue, Mion, Zinn, Macpeak & Seas

[57] ABSTRACT

A broad range of colors within the visible spectrum can be obtained by light interference and multiple refraction in an anodized aluminum product, by electrolytically depositing on an aluminum-based substrate an aluminum oxide anodic film separated from the substrate by an aluminum/aluminum oxide interface. The aluminum oxide anodic film comprises at least three superimposed aluminum oxide anodic layers having different porosities and separated by interfaces between each other, the innermost one of said anodic layers having a non porous barrier layer arranged between the bottom of the pores thereof and the aluminum/aluminum oxide interface. Pigmentary inorganic material is deposited within the pores of the superimposed anodic layers and at least in portions of the interfaces between them, the different colors being produced by varying the current and/or time conditions when depositing the innermost one of the aluminum oxide anodic layers.

37 Claims, 3 Drawing Sheets

COLORED ANODIZED ALUMINUM AND ELECTROLYTIC METHOD FOR THE MANUFCTURE OF SAME

FIELD OF THE INVENTION

The present invention refers to an improved colored anodized aluminum product and to an improved electrolytic method for the manufacture of colored anodized aluminum and, more particularly, it relates to a method for coloring anodized aluminum which is capable of producing a full range of the different colors of the visible spectrum without the need of changing the electrolytic coloring bath, as well as to the colored aluminum products obtained thereby.

BACKGROUND OF THE INVENTION

There are many different types of methods for coloring anodic oxide films. For example, coloring by the absorption of pigments such as anilines, coloring by the formation of pigments inside the anodic film by chemical reaction, coloring by electrolytic deposition of metallic compounds by the passage of an electric current, or coloring by optical methods.

The coloring of aluminum by the formation of a porous anodic oxide film and the electrolytic deposition of inorganic particles within the pores of said film has been known for many years. First, anodization of aluminum, one of its alloys, or other light metal, produces a porous metal oxide film (porous anodic layer) on the metal under alternating or direct current flow in an electrolytic bath in which the metal is suspended. Many different organic and inorganic acids may be combined to create a great variety of electrolytes. Typically, sulfuric acid is most commonly used due to its availability, low cost, and low dissolving power.

In a subsequent electrocoloring step, an inorganic material, typically a metal, is deposited in the pores of the metal oxide film by the passage of an electric current. Typically, alternating current is passed between the anodized aluminum substrate and a counter-electrode. The counter-electrode typically consists of graphite or stainless steel; although nickel, copper, and tin electrodes can also be used. The deposition of the inorganic material functions to give the anodized aluminum a colored appearance. In a porous aluminum oxide film, the pores are evenly spaced apart, and there is a barrier layer of aluminum oxide between the bottom of the pores and the surface of the metal. Inorganic metallic pigments deposited in the pores of the aluminum oxide film result in light being scattered from the lower ends of the individual pigment deposits and from the aluminum/aluminum oxide interface. The color produced depends upon the difference in optical path length resulting from separation of the two light scattering surfaces. The pore diameter and barrier layer thickness are directly related to the applied anodizing voltage.

An increase in the size of the deposits and changes in the colors produced can be achieved by modification of the pores adjacent to the barrier layer, In order to obtain coloring by optical interference effects, however, it has been considered necessary, according to the teachings of the prior art, to provide an anodized aluminum in which the thickness of the anodic oxide layer generated during the process has an average size of greater than about 260 Å, and a separation distance from the aluminum/aluminum oxide interface, i.e., a barrier layer thickness, of between about 300 Å and about 700 Å.

Although the methods for electrolytic coloring of anodized aluminum permit various colors to be obtained, the repertoire of colors produced is often limited to bronzes, blacks and reds. Furthermore, it is often necessary to have a separate coloring bath for each color. In addition, most conventional anodizing procedures use a double anodizing method, exemplified by methods utilizing both sulfuric acid and phosphoric acid-based anodizing solutions to modify the pores of the anodic layer and increase the diameter thereof in order to obtain a larger variety of colors. Use of a second acidic bath solution, such as phosphoric acid, is disadvantageous because it increases the likelihood of contamination by phosphate ions in the electrocoloring method. Contamination by phosphoric acid in this manner may prevent the effective sealing of the final product and lead to the gradual loss of color through weathering.

A method for electrocoloring aluminum with the aim of providing a wider range of colors that was possible with the previous methods is disclosed by Asada, in U.S. Pat. No. 4,022,671, patented on May 10, 1977. The Asada method uses conventional anodizing in sulfuric acid-containing electrolytic bath, followed by a second anodization in a phosphoric acid-containing electrolytic bath under direct current, and coloring in an electrocoloring bath with metallic salts under alternating current. This two-stage anodizing procedure, according to Asada, produces a film that may acquire colors in the range of gray through bronze to black, depending on the treatment time in the electrocoloring bath. Although not expressly recognized by Asada, the treatment of the anodized aluminum by electrolysis in a phosphoric acid bath effects a pore enlargement in the anodic layer, which is responsible for the improvements accomplished by Asada. The method, however, has the above mentioned disadvantage of presenting the serious danger of contaminating the anodized aluminum if suitable means for preventing such contamination are not used, and still leaves much to desire as to the alleged wider range of colors obtained, since said range, although wider than that obtainable with previous methods, is still extremely limited.

Mutsuo Hasegawa et al, in U.S. Pat. No. 4,042,468, patented on Aug. 16, 1977, describes and claims a method for electrocoloring anodized aluminum that mainly comprises treating a previously anodized aluminum piece by electrolysis in a bath containing at least two metallic salts, firstly with direct current and thereafter with alternating current. By the foregoing two steps of electrolysis, Hasegawa claims that the uniformity of the color obtained is much better than that obtained by the prior apt methods, particularly when used for electrocoloring aluminum pieces having protuberant portions that ape normally tinted more intensely than the remainder of the piece. This method, however, is not intended to obtain a wide range of colors in the same bath and, therefore, may only be regarded as a method for improving the uniformity of the colors produced by electrocoloring anodized aluminum, but without any intention of broadening the range of colors obtainable.

The electrolytic coloring of anodized aluminum by means of optical interference effects is disclosed by Sheasby et al in U.S. Pat. No. 4,066,816, patented Jan. 3, 1978 and U.S. Pat. No. 4,152,222, patented May 1, 1979 as a divisional of U.S. Pat. No. 4,066,816. Sheasby teaches a method of coloring anodized aluminum that might be considered as being of the same type of the above described method of Asada. However, the range of colors obtainable by Sheasby is much better than that taught by Asada. This is accomplished by Sheasby by means of the incorporation of a pore enlargement step in the electrolytic process, with the purpose of increasing the diameter of the pores of the anodic layer, particularly at the bases thereof, so as to obtain diameters of over 260 Å. The pore enlargement step of Sheasby may be effected by dissolving the surfaces of the pores of the anodic layer by either chemical or electrochemical means, the latter being preferred to produce a field-assisted dissolution at the base of the pores without much bulk film dissolution, and/or by the growing of an additional anodic layer at the base of the existing anodic layer by the use of an increased voltage of direct current, which increases the length of the enlarged base portions of the pores, as well as the distance between the aluminum/aluminum oxide interface and the bottom of the pores of the existing anodic layer, namely, the so called barrier layer. The pore enlargement step of Sheasby is carried out by treating the previously anodized aluminum by electrolysis in a bath containing an acid having a high dissolving power for aluminum oxide and, depending on the voltage used, the pores of the anodic layer are enlarged, particularly by widening the diameter thereof at their bases, and/or by the growing of a new anodic film under the existing anodic film in order to increase the length of the base portions of the pores and the thickness of the barrier layer. For this step, Sheasby normally uses phosphoric acid, although other acids having a high dissolving power for aluminum oxide can be used. Sheasby finally treats the thus obtained product by electrocoloring the same using metal salts to deposit metallic deposits on the bottom of the enlarged pores of the anodic layer. In order to produce the desired optical interference effect and, therefore, to obtain a wider range of colors, Sheasby requires the presence of large shallow inorganic pigment deposits, preferably accompanied by an increased distance between said deposits and the aluminum/aluminum oxide interface. The deposits must have outer ends of an average size in excess of 260 Å and must be at a distance of 500–3000 Å from the aluminum/aluminum oxide interface. Therefore, Sheasby requires to enlarge the pores of the anodic layer through the use of an electrolytic bath having an acid, such as phosphoric acid, that has a high dissolving power for the aluminum oxide. The use of such acids, however, requires a strict control of the procedure and the acid must be promptly neutralized in order to avoid undue enlargement of the pores and rendering the anodic layer crumbly. On the other hand, use of phosphoric acid tends to contaminate the product and increases the likelihood of unduly redissolving the previously created barrier layer in subsequent process steps, primarily due to the acids remaining in the pores after pigment deposition.

Sheasby et al, in U.S. Pat. No. 4,251,330, patented Feb. 7, 1981, further disclose a process for electrocoloring anodized aluminum which is capable of producing brighter and more intense colors than the process of U.S. Pat. 4,152,222 discussed above. For this purpose, Sheasby carries out the pore enlargement step by the use of an electrolytic bath containing phosphoric acid or other acid having similar strong dissolving power for the aluminum oxide and by the use of alternating current. Although according to Sheasby the whole treatment in the phosphoric acid-based electrolyte is performed under A.C. conditions, in some circumstances a short preliminary D.C. treatment can be employed with advantage. Also according to Sheasby, the electrolyte used for the pore enlargement step may also contain salts of one or more metals, such as tin, nickel or copper, from which coloring deposits are formed during the course of the A.C. treatment. When the electrolyte is free of metal salts which can form pigmentary deposits under A.C., a short anodic D.C. treatment can be employed after the A.C. treatment to slightly thicken the barrier layer in order to reduce the current density in the subsequent coloring stage. This D.C. treatment, however, according to Sheasby, should only be continued for a short time because it results in progressive loss of the advantages of the A.C. treatment. When metal salts are used for coloring purposes in the electrolyte, the D.C. treatment must not be used because it causes redissolution of the coloring deposits. The process described by Sheasby in U.S. Pat. No. 4,251,330, although accomplishing the obtention of brighter and more intense colors as compared with the process of U.S. Pat. No. 4,066,816 and its divisional 4,152,222, still relies on the principles of pore enlargement to provide shallow and extended pigmentary deposits and of barrier layer thickening with the purpose of spacing apart the diffracting surface of the deposits and the aluminum/aluminum oxide interface. This is again accomplished by the use of phosphoric acid or other acid having similar dissolving power for the aluminum oxide and, therefore, it shows the same drawbacks already discussed above.

Sheasby et al, in U.S. Pat. No. 4,310,586, patented Jan. 12, 1982, describes a process for coloring anodized aluminum which is based on the same principles described above, the difference being that, in this particular instance, Sheasby stresses the fact that, in order to increase the distance between the pigmentary deposits and the aluminum/aluminum oxide interface, a second anodic layer of aluminum oxide is formed under the primary anodic layer, that is, under the original barrier layer formed between the bottoms of the pores of the primary anodic layer and the aluminum/aluminum oxide interface. Also, in order to reduce the likelihood of redissolution of the pigmentary deposits when the said second anodic layer is deposited, aided by the residues of the acid used for the pore enlargement step, Sheasby prefers to use metal salts that will form an acid resistant alloy and also prefers to immediately dip the work in a fixative bath, such as a chromate bath, although Sheasby expressly considers this dipping as inconvenient in a commercial operation. The additional anodic layer may be formed as a porous layer or also as a non-porous film indistinctly, which points to the fact that Sheasby is adding this second anodic layer with the sole purpose of increasing the distance between the relatively shallow pigmentary deposits within the enlarged pores of the primary anodic layer, and the aluminum/aluminum oxide interface. The process described in this patent, therefore, also heavily relies on the principle of pore enlargement to increase the area of the pigmentary deposits and to decrease their height, and on the principle of increasing the distance between said shallow deposits and the aluminum/aluminum oxide interface. The use of phosphoric acid of other acid having a similar high dissolving power for aluminum oxide, however, causes exactly the same drawbacks already discussed above, and the attempts of Sheasby to overcome the possibility of redissolution of the pigmentary deposits and of controlling said deposits in order to obtain uniform and stable colors, by dipping the work in a fixative bath and by using acid-resistant metals for providing said pigmentary deposits, cannot be regarded as satisfactory from the commercial point of view, as expressly admitted by Sheasby. On the other hand, none of the processes described by Sheasby et al is able to produce a full color range within the visible spectrum, and the stability of the colors obtained can be achieved only through costly additional fixation steps or through the use of relatively limited ranges of metal salts that can produce acid-resistant alloys upon their electrolytic deposition at the bottom of the enlarged pores. The disadvantages of all the processes described by Sheasby, however, can be considered as caused by the belief of the prior art that control of brightness, intensity and range of colors could only be accomplished by providing relatively shallow, wide pigmentary metal deposits, for which purpose a pore enlargement step was considered as mandatory, thus requiring the use of an electrolyte containing an acid having a strong dissolving power towards aluminum oxide, such as phosphoric acid and the like.

Other electrolytic procedures use complex wave forms, such as asymmetric sine waves, to increase the quality of the final product by producing more consistent colors. These wave forms, however, are generally complex and require expensive equipment making their use impractical.

None of the processes of the prior art, however, is capable of producing a full range of colors within the visible spectrum without the change of coloring baths, and furthermore, none of said prior art processes is capable of producing, in a practical manner, colored aluminum products having stable and uniform colors, unless relatively difficult fixation steps or acid-resistant coloring metals are used, with the consequent increase in the costs and decrease in the efficiency of production.

OBJECTS OF THE INVENTION

Having in mind the defects of the prior art processes for coloring anodized aluminum, it is an object of this invention to provide an electrolytic method for coloring anodized aluminum which will produce a wide variety of colors, quickly and efficiently without the use of harmful acidic baths and/or cumbersome fixation steps and/or acid-resistant pigmentary metal deposits, which make the method mope expensive and complex.

Another object of the present invention is to provide an electrolytic method for coloring anodized aluminum which will not require a pope enlargement step for increasing the diameter of the popes of the anodic layer and will therefore avoid the necessity of using contaminating acids having a high dissolving power towards aluminum oxide.

One other object of the invention is to provide an electrolytic method for coloring anodized aluminum which will obtain the full range of colors of the visible spectrum in a simple and uniform manner without the need of using different and separate electrocoloring baths.

Another object of the present invention is to provide an electrolytic method for coloring anodized aluminum which will absolutely prevent contamination of the finished product by avoiding the use of electrolytic baths containing acids having a strong dissolving power towards aluminum oxide such as phosphoric acid.

A further and more specific object of the invention is to provide a method for coloring anodized aluminum which will produce the full range of colors of the visible spectrum by generating different superposed aluminum oxide anodic layers having different indexes of refraction which decompose light when it passes through the layers.

Another object of the present invention is to provide an electrocolored anodized aluminum product having an anodic film constituted by at least three superposed aluminum oxide anodic layers having different indexes of refraction and different types of pores, and pigmentary inorganic material randomly deposited in the pores of each of said at least three aluminum oxide anodic layers.

SUMMARY OF THE INVENTION

The foregoing objects and others ancillary thereto are preferably accomplished as follows:

According to a preferred embodiment of the present invention, the method for the electrolytic coloring of a metallic substrate such as aluminum or an aluminum alloy, essentially comprises the steps of:

a) developing a porous anodic layer on the substrate in a conventional sulfuric acid-based electrolytic bath under D.C. conditions;

b) reducing the thickness of the barrier layer, namely, the aluminum oxide layer between the bottom of the pores of the anodic layer and the aluminum/aluminum oxide interface, by electrolytically treating the substrate in a bath which may or may not contain metallic salts for providing the pigmentary deposits, under D.C. conditions, in order to clean the walls of the pores and to dissolve the bottoms thereof by current-assisted dissolution, until the barrier layer is reduced to the desired thickness;

c) electrolytically treating the substrate under A.C. conditions in order to deposit a second anodic layer under the first anodic layer, said second layer having much finer pores than the first anodic layer;

d) electrolytically depositing a third anodic layer under the second anodic layer, preferably in the same electrolytic bath but under D.C. conditions, said third anodic layer having fine pores with much thicker walls than the second anodic layer; and e) electrolytically depositing pigmentary metals within the pores of the three combined layers and at the interfaces between said layers, by the use of A.C.

In a preferred embodiment of the invention, the metal salts to electrolytically deposit the inorganic material which will constitute the pigmentary deposits, are provided in the bath used for step (b) which will therefore be equivalent to an electrocoloring bath, and the remaining steps (c) to (e) are carried out in the said electrocoloring bath.

In another aspect of the invention, the electrolytic deposition of the pigmentary material can be effected in a separate electrocoloring bath.

In a further aspect of this invention, direct current is optionally applied to the metallic substrate after the electrolytic deposition of inorganic material to partially and controlledly redissolve the inorganic deposits. This procedure allows for fine scale adjustment of the color tone, and more precise control of the colors of the final product.

In a still further aspect of this invention, an electrocolored anodized aluminum product is provided, which comprises an aluminum-based substrate having an anodic film constituted by at least three superposed aluminum oxide anodic layers having different indexes of refraction and different types of pores, and pigmentary inorganic material randomly deposited in the pores of each of said at least three aluminum oxide anodic layers.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments when read in connection with the accompanying drawings, in which:

FIG. 8 is a view of the structure of the metallic substrate treated by the method of the present invention as it would be seen with the use of a high resolution electronic microscope.

DETAILED DESCRIPTION

Figure 3:
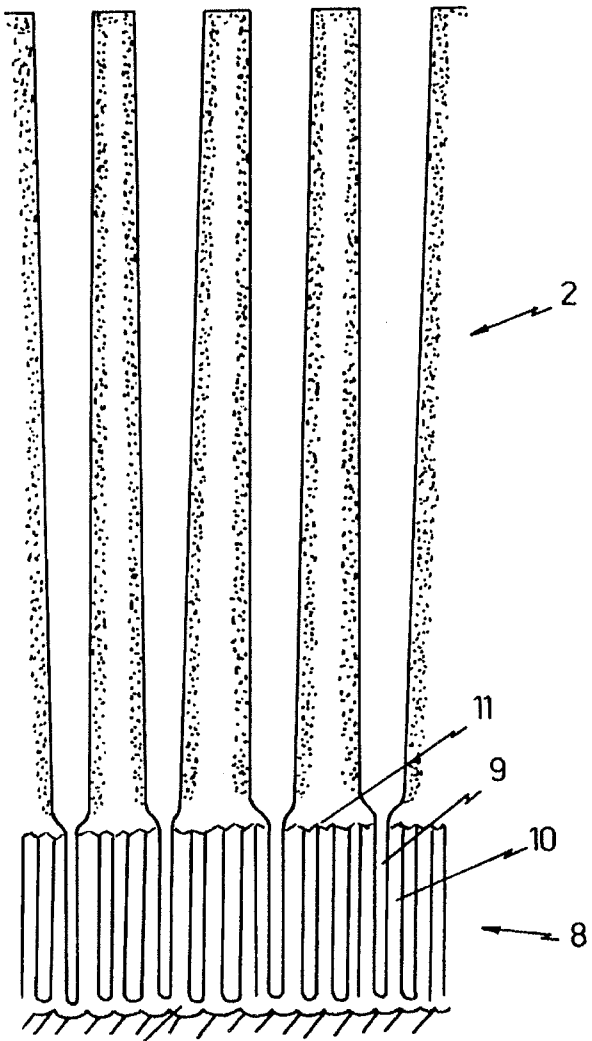
FIG. 3 is a diagrammatic view of the substrate illustrated in FIGS. 1 and 2 but having a second porous anodic layer under the first or conventional anodic layer.

The present invention involves an improved method for electrolytic coloring of an aluminum-based substrate by light decomposition due to refraction, reflection and dispersion through multiple superimposed porous aluminum oxide layers.

The method of the present invention utilizes three well known phenomena for coloring a metallic substrate, namely, refraction, reflection and dispersion, As it is well known to those skilled in the art, refraction is the modification of light waves by superimposed semi-transparent films having different refractive indexes that cause light to change from its pristine form to a spectral form; reflection is the total or partial emulation of the incident light at an angle equal to the difference between its angle and an angle normal to the surface; and dispersion is the specific difference in refractive index of two or more wave lengths when passing through two or more semi-transparent media that causes an incident light beam to emerge with modified characteristics of wave length and direction. The phenomenon of reflection of light from reflective surfaces located at short distances to each other is capable of producing optical interference between light reflected from said surfaces, thus generating a color which nature will depend on the separation of any two reflecting surfaces. The range of colors produced by the product obtained by the method of the present invention, therefore, will depend on the complex combination of refraction, reflection and dispersion produced in the pores and the reflecting surfaces of the pigmentary deposits therein, as well as on the interference phenomenon deriving from the different reflecting surfaces contained in the anodic oxide layers and the aluminum/aluminum oxide interface underlaying said anodic translucent layers. In other words, the method of modifying light waves by means of the superimposed anodic layers of the product of the present invention is done mainly by a series of relating angles of incidence and emergence at the interfaces of the media through which the light passes. The different media are superimposed stages of the metallic product that differ in thickness, density, reflection index and pore morphology. The incident light is absorbed then reflected and refracted several times because of the different refractive indexes of the superimposed layers. The light is then dispersed according to the specific wavelengths and is finally reflected as emergent light.

The manner in which the above phenomena are carried out in the product of the present invention is not fully understood, but it has been discovered that, by superposing not less than three anodic porous aluminum oxide layers of different porosity on the aluminum substrate, it is possible to obtain the full range of colors of the visible spectrum without the need of changing the composition of the electrocoloring bath, since the different colors are produced by the mere variation of the current, temperature and time conditions under which the different stages of the process of this invention are carried out, as will be clearly seen hereinafter.

As already mentioned above, the method of the present invention to generate a colored anodized aluminum product is carried out by the following basic steps:

a) developing a porous anodic layer on the substrate in a conventional sulfuric acid-based electrolytic bath under D.C. conditions;

b) reducing the thickness of the barrier layer, namely, the aluminum oxide layer between the bottom of the pores of the anodic layer and the aluminum/aluminum oxide interface, by electrolytically treating the substrate in a bath which may or may not contain metallic salts for providing the pigmentary deposits, under D.C. conditions, in order to clean the walls of the pores and to dissolve the bottoms thereof by current-assisted dissolution, until the barrier layer is reduced to the desired thickness;

c) electrolytically treating the substrate under A.C. conditions in order to deposit a second anodic layer under the first anodic layer, said second layer having much finer pores than the first anodic layer;

d) electrolytically depositing a third anodic layer under the second anodic layer, preferably in the same electrolytic bath but under D.C. conditions, said third anodic layer having fine pores with much thicker walls than the second anodic layer; and e) electrolytically depositing pigmentary metals within the pores of the three combined layers and at the interfaces between said layers, by the use of A.C.

In a preferred embodiment of the invention, the metal salts to electrolytically deposit the inorganic material which will constitute the pigmentary deposits, are provided in the bath used for step (b) which will therefore be equivalent to an electrocoloring bath, and the remaining steps (c) to (e) are carried out in the said electrocoloring bath.

In another aspect of the invention, the electrolytic deposition of the pigmentary material can be effected in a separate electrocoloring bath.

In a further aspect of this invention, direct current is optionally applied to the metallic substrate after the electrolytic deposition of inorganic material to partially and controlledly redissolve the inorganic deposits. This procedure allows for fine scale adjustment of the color tone, and more precise control of the colors of the final product.

Before a metal substrate is subjected to the method of the present invention, it is prepared using conventional methods for achieving a uniform, smooth and attractive finish. Typically, these initial well known treatments include degreasing, etching, matting, polishing, rinsing, neutralizing, and the like.

The prepared metal substrate is then introduced in an anodic oxidation tank, which generally contains a sulfuric acid-based electrolytic bath. Additives can be used in the sulfuric acid-based bath to diminish the dissolution strength of the electrolyte towards aluminum oxide.

After the metal substrate is introduced in the tank containing the bath, the substrate is subjected to an anodizing flow of direct current (D.C.). In the present system, the metal substrate is the positive electrode (anode), while the negative electrode (cathode) can be made of aluminum, carbon, lead, stainless steel and the like.

Figure 1:
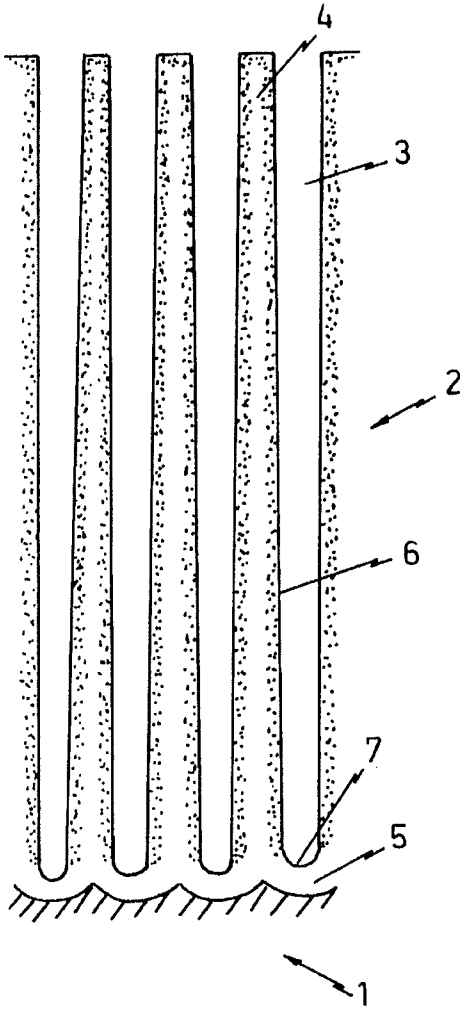
FIG. 1 is a cross sectional diagrammatic view of an aluminum substrate to which a conventional anodic aluminum oxide layer has been applied, showing the pores and the barrier layer left between the bottom of said pores and the aluminum/aluminum oxide interface.
Figure 5:
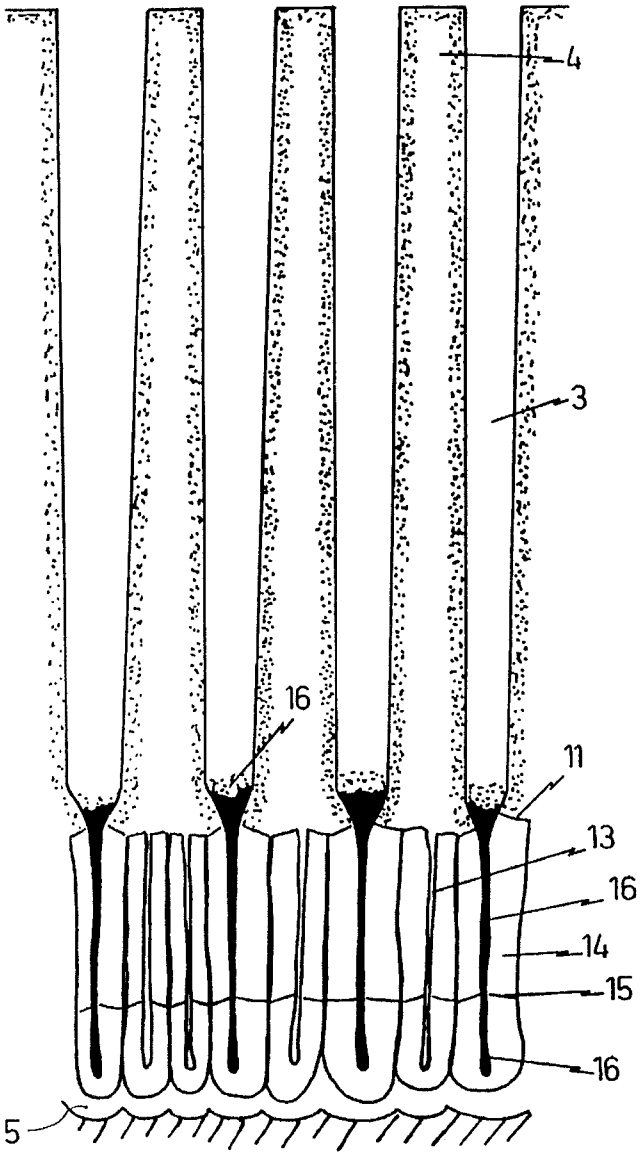
FIG. 5 is a diagrammatic view of the substrate of FIG. 4 but showing the deposits of pigmentary material within the pores of the anodic layers.

In the anodizing step, as shown in the diagrammatic view of FIG. 1, the substrate 1 is aluminum, and an anodic aluminum oxide layer 2 is formed on the substrate 1. The anodic layer 2 is porous and contains a plurality of evenly spaced pores 3. A barrier layer 5 of non porous aluminum oxide deposited next to the substrate 1 is defined as the distance between the bottom 7 of the pores 3 and the substrate 1. The thickness of the anodic layer 2, the thickness 4 of the walls 6 of the pores 3 and the diameter, length and depth of the pores 3 may be varied at will by controlling the time, which will determine the pore wall thickness; voltage, which will determine the barrier layer thickness; and temperature, which will determine the pore diameter in addition to the dissolution rate of the anodic layer, and current density.

The types of current used to develop the anodic layer are not critical to the functioning of this invention. Direct current, alternating current, or alternating current with direct current components, either in sine, square, or pulsed waves, in any of their frequencies, can be employed in the anodizing step as is well known in the art. Typically, D.C. voltages of between about 5 and about 25 volts are used in sulfuric acid-based electrolytes, depending upon the strength and temperature of the acid. Generally, the thickness of the resulting barrier film is about 10 Å per volt. The time during which the anodization step is carried out is typically of between about 15 and about 35 minutes.

Typically, in the sulfuric acid-based electrolytic bath the electrolyte contains between about 5 and about 20 percent, by weight, sulfuric acid, at a temperature of from about 20° C. to about 25° C. and a D.C. voltage of between about 15 and about 25 volts. In general anodizing in a sulfuric acid-based electrolytic bath produces pore diameters of between about 150 Å and about 180 Å (15–18 nm). Barrier layer thickness is typically about equal to the pore diameter in the anodization step. These same conditions hold true with mixed sulfuric acid-oxalic acid-based electrolytes.

The thus obtained anodized aluminum substrate is then subjected to the novel treatment of the present invention with the purpose of coloring the same uniformly and efficiently with colors that cover the full optical spectrum and that are firm and weather-resistant.

For carrying out the method of coloring anodized aluminum, it is an important aspect of the present invention that the electrolytic bath used in the further anodizing and electrocoloring steps lacks strong dissolving power for the aluminum oxide that constitutes the various anodic layers that are deposited under the above described first or basic anodic layer. The net speed in which the film width, or thickness, desired is achieved is determined by the total growth speed minus the total dissolution speed. The dissolution velocity is determined by dissolving power, which is characterized by the electrolyte type and temperature.

Preferably, the electrolytic bath for the formation of additional anodic aluminum oxide layers having different indexes of refraction and for the electrocoloring of the anodized aluminum, in accordance with this invention, includes a sulfuric acid-based aqueous solution which comprises between about 10 and about 40 g/l sulfuric acid; between about 5 to about 15 g/l of tin salts such as tin sulfate (stannous sulfate), between about 0.01 to about 2.5 g/l of reducing acids such as tannic acid or other organic acids such as carboxylic acids, tartaric acid, citric acid, sulfamic acid, glycolic acid, malonic acid, boric acid, oxalic acid and mixtures thereof; between about 0.1 and 10 g/l sulfonic acids, preferably 4-sulfophthalic acid; and a suitable surfactant such as linear alkyl sulfonates, alkyl benzene sulfonates, long-chain alcohols of fatty acids, soaps and polyalcohols such as glycerin in an amount of between 0.2 and 10.0 g/l.

A highly preferred electrolyte for use in carrying out the various additional anodizing steps and the electrocoloring step in accordance with the present invention consists of an aqueous solution of from about 10 to about 20 g/l of sulfuric acid, from about 7 to about 15 g/l of stannous sulfate, from about 0.03 to about 1.0 g/l of tannic acid, from about 0.1 to about 6.0 g/l of 4-sulfophthalic acid, and from about 0.5 to about 5.0 g/l of glycerin.

The electrolytes used for electrocoloring anodized aluminum by the use of most of the methods in accordance with the prior apt normally include concentrations of metal salts for forming the electrocoloring deposits of inorganic materials as high as 25 g/l and of not less than about 5 g/l and must use different metal salts for the obtention of different ranges of colors, such as copper, iron, cobalt, nickel, tin, silver, cadmium, lead, manganese, molybdenum and the like. The methods for electrocoloring anodized aluminum in accordance with the prior art, therefore, need of separate electrocoloring baths for the production of different ranges of colors and also need of relatively high concentrations of the metal salts in order to produce reasonably uniform and intense colors within said rather narrow ranges. On the contrary, the electrolyte of the present invention only uses one single type of metal salt, such as a tin salt, preferably stannous sulfate, at much lower concentrations which render the method more economical and with the remarkable results that the full range of colors within the visible spectrum are possible, due to the combination of the chemical efficiency of the electrolyte and the electrolytic conditions, which will be described in detail hereinafter, under which the method of the present invention is carried out.

Although tin salts are highly preferred to formulate the electrolyte of the present invention, It will be apparent to any one skilled in the art that other metal salts can be used. The electrolyte, once formulated with any metal salt such as tin, copper, iron, cobalt, nickel, silver, cadmium, lead, manganese, molybdenum or the like, will be useful without any change of formulation, for the above described purposes of producing the additional anodic layers and of electrocoloring the anodized aluminum substrate. However, it has been found that stannous salts are the most efficient compounds for the formulation of the electrolyte.

The electrolyte containing only water, sulfuric acid and stannous sulfate in accordance with the present invention, occasionally does not produce a uniform color due to several reasons. Among the most important ones of said reasons is the fact that the stannous sulfate is easily oxidized by the oxygen in the air to stannic sulfate, thus considerably decreasing the efficiency of the electrolyte to properly deposit inorganic coloring material within the pores of the anodic layers. The loss of stannous tin in favor of the formation of stannic tin, which is extremely aggressive towards the anodic layers, tends to form powdery non-reflecting deposits of inorganic materials within the pores of the same, which are absolutely unsuitable for producing the reflection-refraction-dispersion interference effect desired for the obtention of wider ranges of colors. Therefore, it has been found that, in order to maintain a reducing system within the electrolyte for preventing the oxidation of stannous tin into stannic tin, it is necessary to add to said electrolyte a reducing acid and, for this purpose, tannic acid is preferred, although other types of reducing acids such as those mentioned above could be alternatively used without departing from the spirit of the present invention.

Tannic acid, by preventing the oxidation of the stannous tin, maintains the solution clear and clean, because the stannic tin, being much less soluble in the solution than stannous tin, imparts a milky aspect to the electrolyte which is extremely difficult to remove by mere filtration or the like unless the temperature of the solution is lowered to less than about 5° C. to produce agglomeration of the precipitate which can thereafter be filtrated. The addition of tannic acid, therefore, eliminates the necessity of having to use a rather costly separation procedure which would be necessary otherwise.

Another important reason is that the basic electrolyte has sufficient wetting power because it has a relatively high surface tension. The surface tension of the electrolyte in accordance with the present invention is considerably reduced by the use of the surfactant, glycerin being preferred for said purpose. The addition of the surfactant permits the electrolyte to have a stronger penetration into the pores of the anodic layers and therefore the obtention of a more uniform and intense color.

In order to accomplish the results of producing a full range of colors within the visible spectrum, with a high uniformity and reproducible characteristics, it is mandatory in accordance with the present invention that the electrolyte has a very low dissolving power towards the aluminum oxide anodic layers. The dissolving power of the electrolyte in accordance with the present invention is low in itself because of the concentration of sulfuric acid used, but said dissolving power is preferably furtherly reduced by the addition of sulfonated acids, preferably 4-sulfophthalic acid which has been found to have the properties of reducing the dissolving power of the electrolyte towards the anodic aluminum oxide layers and of rendering the colors obtained more uniform.

It is to be stressed that the present method does not utilize phosphoric acid or other acids in higher concentrations, having dissolving power similar to phosphoric acid. As noted above, use of an electrolytic bath having a high dissolving power is disadvantageous by increasing the likelihood of contamination and anodic layer dissolution, including barrier layer dissolution. For example, it has been shown that a phosphoric acid electrolyte, at a concentration of 100 g/l at 20° C., has greater than 200 times more dissolving power than the electrolytic baths of the present invention. The dissolving power or dissolution speed of phosphoric acid is so high that it is often necessary to reduce the same by adding chromic acid or the like, which in itself constitutes a further source of contamination of the final product.

Figure 2:
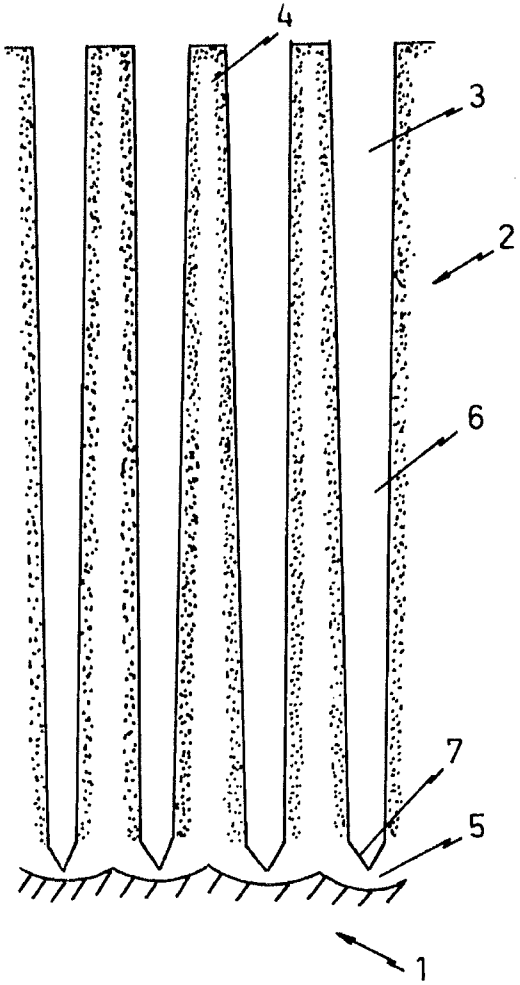
FIG. 2 is a diagrammatic view similar to FIG. 1 but showing a thinner barrier layer provided by the step of removing material from the bottom of the pores.

In order to carry out the method of the present invention, a previously anodized aluminum substrate containing an anodic aluminum oxide layer obtained by the use of the conventional anodizing process in a sulfuric acid-based electrolyte, is introduced in an electrolytic bath formulated in accordance with the invention as described above, said anodized aluminum substrate being arranged as the anode and a cathode made of stainless steel, tin, carbon and the like is also introduced in the electrolytic bath, The first step in accordance with the present invention is carried out by passing a D.C. of 25 volts or less through the electrodes, under a temperature of about 18° to 22° C. for a time sufficient to clean the inner walls 6 of the pores 3 and to slightly dissolve, by a current-assisted dissolution phenomenon, the barrier layer 5 at the bottom 7 of the pores, thus reducing the thickness of said barrier layer 5 as shown in the diagrammatic view of FIG. 2, in order to facilitate the passage of electric current therethrough in the remaining steps of the method of the present invention.

The thusly modified anodized aluminum substrate is then subjected, within the same electrolytic bath, to an A.C. treatment by using an A.C. of 15 volts of less, preferably of 7 volts of less, at a temperature of from about 18° to 22° C. and for a time of about 15 minutes or less. This A.C. treatment deposits a second anodic aluminum oxide layer 8 under the first anodic layer 2 as shown in FIG. 3. The second anodic layer 8 has a different pope structure as compared with the first anodic layer 2, having narrower and more numerous popes 9 with thinner walls 10 and a different refractive and reflective index, thus forming a partition surface 11 between the first and the second anodic layers 2 and 8, respectively. By these means, it can be seen that the substrate shown in FIG. 3 has two differentiated superimposed anodic aluminum oxide layers, each having different optical properties.

Figure 4:
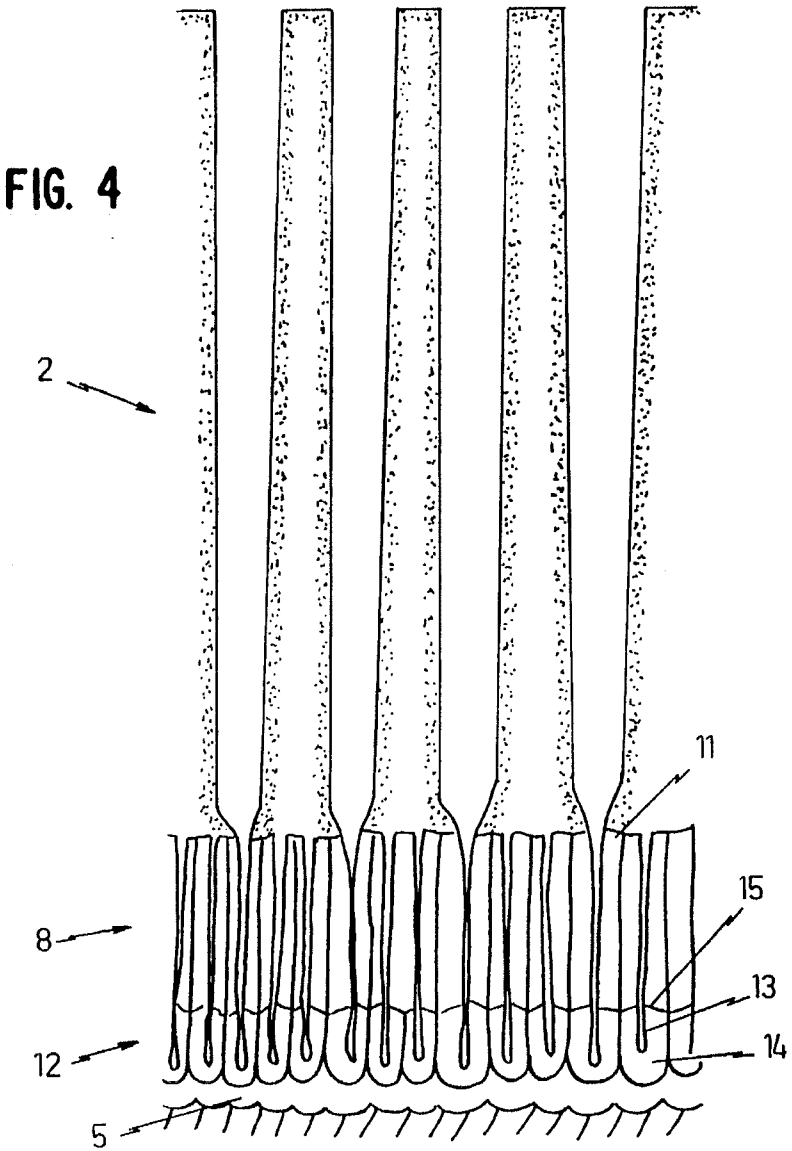
FIG. 4 is a diagrammatic view of the substrate illustrated in FIG. 3 but having a third porous anodic layer under the second anodic layer.

The next step of the method in accordance with the present invention is carried out within the same above described electrolyte under the same temperature range, but now using a D.C. of 25 volts or less for a period of time of from about I minute to about 10 minutes, depending on the color desired for the aluminum product. This D.C. treatment produces a third anodic aluminum oxide layer 12 under the second anodic layer 8 as shown in FIG 4. The third anodic layer 12 is constituted by still finer pores 13 having relatively thick walls 14 and showing different refractive and reflective indexes as any one of the two other superimposed anodic layers 2 and 8. A very bright or mirror-like surface 15 is formed at the interface of the anodic layers 8 and 12 as shown in the diagrammatic view of FIG. 4.

The electrocoloring step of the method of the present invention is carried out in the same electrolyte described above and without changing the temperature, by passing through the electrodes an A.C. of from about 15 to about 25 volts, preferably from about 15 to about 18 volts and still more preferably of 18 volts, for a period of time which will depend on the color desired but which is generally less than about 10 minutes. In this step, inorganic or metallic materials identified by the reference numeral 16 are deposited within the pores of the three above described anodic layers, as well as on the interfaces of each layer under strictly controlled chemical and electrolytic conditions, in order to produce any desired color within the visible spectrum, in an easily reproducible manner by the mere control of the conditions of the different steps of the process, which can be accomplished by the use of a data processor with a suitable program for each desired color.

The various steps of the above described electrocoloring method for anodized aluminum-based substrates utilizes both D.C. and A.C. without modifying its sinusoidal form, which renders the equipment for providing said currents more economical and simple. The electrical equipment, as mentioned above, can be controlled by a data processor for handling ramp type voltages and for providing a high precision in the voltages used, which in order to produce uniform results, must not vary beyond approximately 0.3 volts of oscillation. A specific program can be designed for each color and, therefore, the operator will simply call the desired program to carry out the sequence of steps described above for the production of the color desired.

Although the sequence of steps described above will normally produce very stable, intense and well defined and reproducible colors covering the full range of the visible spectrum, it is possible, in accordance with the present invention, to insert further anodic layers under the three above described anodic layers which constitute the minimum number of layers to produce the full range of colors, with which the shades of the colors may be varied more easily. However, the addition of further anodic layers implies cost considerations that may render the method too costly for certain applications. The product of the present invention, therefore, preferably contains three superimposed anodic aluminum oxide layers in order to produce the effects desired and described above, but may contain additional pairs of anodic layers if a wider variation of the color shades is desired for certain applications where cost is not of relevance.

On the other hand, for more accurate control of the color shades obtained through the provision of the three above described superimposed anodic layers and the pigmentary inorganic deposits within their pores, a final "fine tuning" D.C. treatment can be carried out with the purpose of partially redissolving the said pigmentary metallic deposits. The purpose of this final treatment after electrolytic deposition of the inorganic materials under A.C. conditions is to reduce the intensity of the color by redissolving inorganic material deposits. The D.C. treatment is continued for a short period of time of between about 0.5 to 3 minutes. The current is at a voltage less than about 25 volts. This step allows a fine scale adjustment of the amount of inorganic material deposits, resulting in muted colors and a more precise control of the final aluminum or aluminum alloy colored product, When the anodic layers are formed and the barrier layer is modified by the method of the present invention in the above described electrolytic bath, which in itself is an electrocoloring bath, the electrolyte includes metal salts, therefore pigmentary deposits can form under A.C. conditions. Thus, formation of additional oxide layers or modification of the barrier layer can occur simultaneously with formation of inorganic material deposits. The specific voltage sequences described herein can, however, be employed to more precisely control the formation of the anodic layers and barrier layer thickness at the same time eliminating inorganic material deposition prior to actual electrocoloring in the final step described above.

The A.C. treatment used for forming the second anodic layer B (FIG. 3), which would normally deposit unwanted inorganic material pigments in an electrocoloring bath such as the electrolytic bath used in accordance with the present invention, is chosen to keep the inorganic material deposition to an absolute minimum. One way to accomplish this is to apply an A.C. treatment by using a current having a lower voltage than that which is necessary to initiate the deposition of the metal contained in the metallic salts in the electrolytic bath. Preferably this A.C. treatment is carried out at voltages lower than about 20 volts, which is the voltage at which inorganic material commences to be deposited within the pores of the anodic layers. The step of depositing the inorganic material or metal within the pores of the superimposed anodic layers and at the interfaces provided between each pair of said anodic layers is therefore, as described above, effected by means of an A.C. treatment under a much higher voltage, with which formation of additional anodic layers is prevented and deposition of the metals is favored.

The electrocoloring step is typically followed by a pore sealing step, known to those skilled in the art. In this last step, the anodic aluminum oxide film produced by the method of the present invention acquires most of its corrosion resistance. The sealing is done in water of high purity, at between about 90° C. to about 100° C. It is important to use high purity water to obtain resistant films. However, nickel acetate and cobalt acetate solutions in deionized water can also be used at nearly boiling temperatures for sealing the product. The concentrations of said salts in deionized water are generally of between about 2 to about 7 g/l nickel acetate and from about 0.5 to 2 g/l cobalt acetate. As noted above, the use of electrolytic baths according to the present invention, having a low dissolving power for the metallic oxide layers, excluding phosphoric acid, lessens the risk of having detrimental phosphate contaminants in the sealing method.

Although as already mentioned above, the method for electrocoloring anodized aluminum in accordance with the present invention is capable of accomplishing the goal of producing an extremely wide range of colors within the visible spectrum, and may even produce the full range of visible colors, through the provision of three superimposed anodic layers of different properties to each other, as follows:

1. DC treatment to clean pores and to reduce the thickness of the barrier layer;
2. AC treatment to produce a second anodic layer under the normal anodic layer of the substrate;
3. DC treatment to produce a third anodic layer under the second anodic layer; and
4. AC treatment to deposit pigmentary inorganic material; and, if desirable,
5. DC optional final treatment for fine adjustment of the color;

other sequences of steps may be carried out without departing from the true scope and spirit of the invention, with the obtention of similar results, namely, the production of an extremely wide range of colors within the visible spectrum.

For instance, the following sequences of steps may also be used:

AC - DC - AC (which omits the preliminary DC cleaning treatment).

DC - AC - DC - AC - DC - AC (which provides two additional anodic layers).

These modified sequences may also include the optional step of fine adjustment of the color as follows:

AC - DC - AC - DC

DC - AC - DC - AC - DC - AC - DC.

Figure 6:
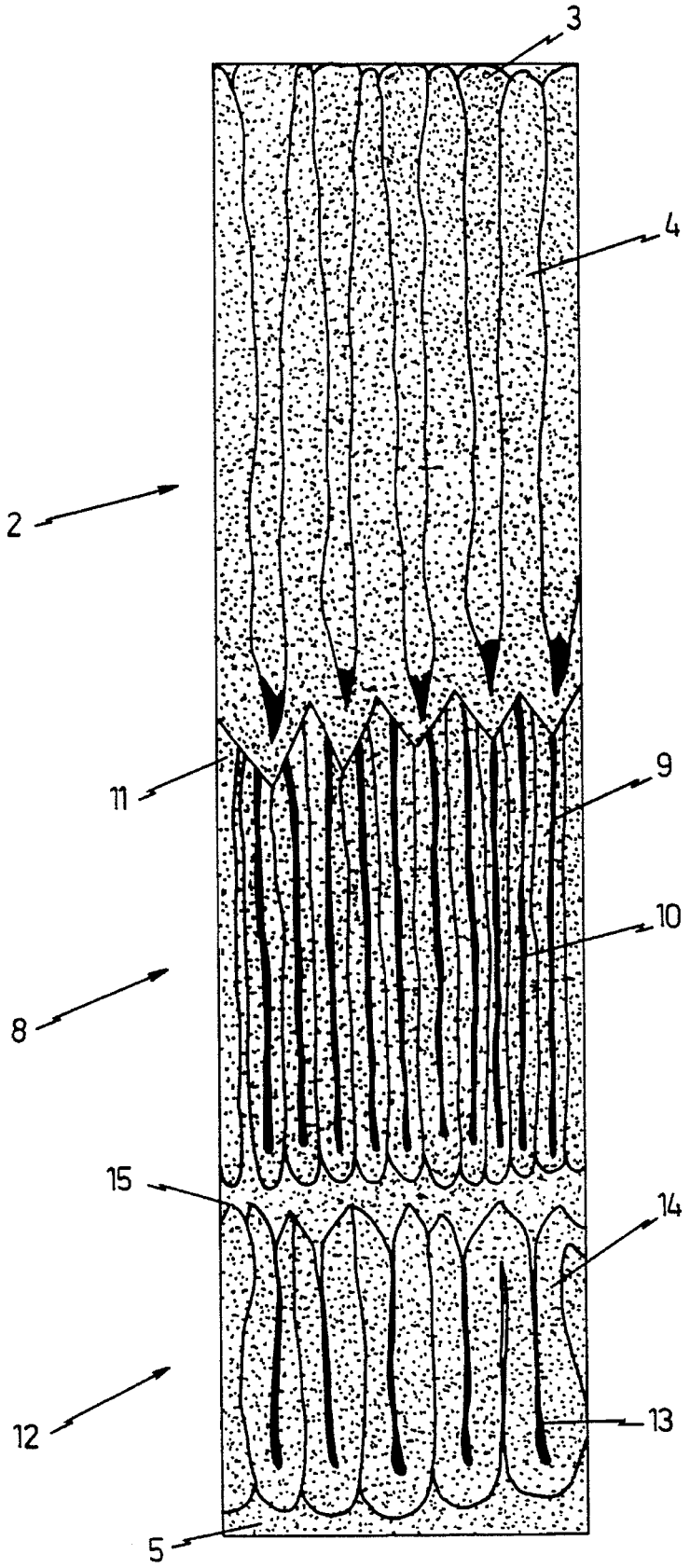

The anodized aluminum product obtained by the above described method of the present invention is shown in FIG. 6 of the accompanying drawings, which represents a view of a cross section of the product showing the three anodic layers as they would be seen with a high resolution electronic microscope. In fact, said view was obtained by a combination of several microphotographs taken with model JEOL-1200EX electronic microscope and analyzed with an EDX-system probe to distinguish the differences of the anodic layers.

As it can be clearly seen in FIG. 6, the aluminum product of the present invention comprises at least three superimposed anodic aluminum oxide porous layers 2, 8 and 12 and a barrier layer 5 between the pores of the innermost anodic layer 12 and the aluminum-based substrate 1 (not shown in FIG. 6). The outer anodic layer 2 comprises pores 3 having a relatively large diameter and spaced by relatively thick walls 4. The intermediate anodic layer 8 comprises fine pores 9 spaced by relatively thin walls 10. The innermost anodic layer 12 comprises very thin pores 13 spaced by considerably thick walls 14.

The present invention will be further illustrated by the following examples which are intended to be illustrative in nature and are not to be construed as limiting the scope of the invention.

EXAMPLE 1

A piece of aluminum was anodized for 20 minutes in a conventional electrolyte made with 170 g/l of sulfuric acid and 5 g/l of aluminum in solution at 20° C. A direct current of 17 volts was applied between the piece of aluminum as the positive pole and a lead electrode as the negative pole for 30 minutes. An anodic layer of aluminum oxide having a thickness of about 16 microns and a refractive index of 1.597 was produced.

The above anodized piece was then immersed in an electrolyte having 20 g/l of sulfuric acid, 15 g/l of tin sulfate, 2.5 g/l of tannic acid and 0.7 g/l of citric acid. A direct current of 16 volts was applied to the anodized piece for about 2 minutes to clean the inside of the pores and to reduce the thickness of the barrier layer preparing the substrate for further treatment.

In the same electrolytic bath an alternating current of 5.0 volts was applied for about 10 minutes to produce a second anodic layer having different characteristics, under the first above anodic layer. This second anodic layer had a pale yellowish color, because of higher sulfur quantities, an approximate thickness of 1.1 microns and a refractive index of 1.48.

The thus obtained substrate was then treated with a direct current of 17 volts for a period of 3.5 minutes for creating a third anodic aluminum oxide layer having an approximate thickness of 0.25 microns and a refractive index of 1.62.

Lastly, an alternating current of 19 volts was applied for 3 minutes in order to deposit tin metal within the pores of the three anodic layers and at the interfaces between each pair of said anodic layers. The piece was then sealed by the traditional method in boiling water of high purity for a period of time of minutes. A medium light red color with a shiny appearance was obtained.

Referring now to FIG. 6, the various layers of the above product were studied by taking several microphotographs with a high resolution electronic microscope, Model JEOL-1200EX, and analyzing said layers with a EDX-system probe to differentiate each one of the three layers. The results obtained by the study show an anodic film having three different layers and having the characteristics shown in the following table as identified by the different steps of the process as carried out in this Example:

TABLE 1

| Treatment | Layer | Anodic Film (microns) | Increment (microns) | Density (g/cc) |
|---|---|---|---|---|
| Conventional Anodizing | 2 | 15.6 | — | 2.70 |
| Cleaning, DC | 2 | 15.6 | 0 | 2.70 |
| Oxidation, AC | 8 | 16.7 | 1.1 | 2.59 |
| Oxidation, DC | 12 | 16.95 | 0.25 | 2.60 |
| Deposition, AC | — | 16.90 | −0.05 | 2.68 |

As it is shown on Table 1, the densities of the anodic film have a minimum dissolution along the entire method of 0.1 g/cc (2.7–2.6 g/cc). This is equivalent to a 3.7% total film loss (0.1 divided by 2.7 g/cc). This compares favorably to the methods of the prior art, including that disclosed in the Sheasby '586 patent wherein a 33.3% total film loss is noted.

EXAMPLE 2

A work piece of a 6063-T5 aluminum alloy was degreased and deoxidized in a 12% sulfuric acid solution also containing a detergent for a period of time of 10 minutes. The work piece was rinsed with water and thereafter etched in a 7% sodium hydroxide solution at 60° C. for 12 minutes. The aluminum piece was then again rinsed with water and neutralized in a 15% sulfuric acid solution under stirring for 5 minutes.

The thus cleansed and degreased work piece was then anodized in a solution containing 200 g/l sulfuric acid and 6 g/l aluminum metal for 35 minutes at a temperature of 21° C. by the use of a direct current of 16 volts and using aluminum cathodes, whereby an anodic aluminum oxide layer of approximately 16 micron thickness was obtained, and the anodized piece was thoroughly rinsed with water.

The anodized piece was then immersed in an electrocoloring bath containing 9 g/l stannous sulfate, 17 g/l sulfuric acid, 5 g/l 4-sulfophthalic acid, 0.3 g/l tannic acid and 1 g/l glycerin at a temperature of 21° C. and using stainless steel counter-electrodes. Within said electrocoloring bath, the anodized work piece was subjected to the following electrolytical sequence:

a) A direct current stage comprising a voltage ramp growing from 0 to 11 volts in 10 seconds and remaining constant at 11 volts for the next 15 seconds; followed by b) An alternating current stage comprising a voltage ramp growing from 0 to 5 volts in 5 seconds and remaining at 5 volts for the next 20 seconds and then a voltage ramp decreasing from 5 to 3 volts in 3 seconds and remaining at 3 volts for the next 90 seconds and finally a voltage ramp decreasing from 3 to 2.3 volts in 260 seconds; followed by c) A direct current stage comprising a ramp growing from 0 to 15 volts in 30 seconds and remaining at 15 volts for the next 60 seconds; followed by d) An alternating current stage comprising a ramp growing from 0 to 16 volts in 30 seconds and remaining at 16 volts for the next 250 seconds.

The fully anodized work piece of aluminum alloy treated under the above sequence showed a grey color, which was duly preserved by rinsing the work piece with water and sealing the anodic film in boiling water for a period of time of 40 minutes.

EXAMPLE 3

The method described in Example 2 was repeated, with the only exception that step (c) of the electrolytical sequence was carried out by using a direct current stage comprising a ramp growing from 0 to 15 volts in 30 seconds and remaining at 15 volts for the next 80 seconds, whereby a blue color was obtained.

EXAMPLE 4

The method described in Example 2 was again repeated, with the only exception that step (c) of the electrolytical sequence was carried out by changing the residence time at 15 volts to 120 seconds, with which a light green color was obtained.

EXAMPLE 5

The method described in Example 2 was again repeated, with the only exception that step (c) of the electrolytical sequence was carried out by changing the residence time at 15 volts to 250 seconds, with which an orange color was obtained.

EXAMPLE 6

The method described in Example 2 was again repeated, with the only exception that step (c) of the electrolytical sequence was carried out by changing the residence time at 15 volts to 350 seconds, with which a brown color was obtained.

EXAMPLE 7

The method described in Example 2 was again repeated, with the only exception that step (c) of the electrolytical sequence was carried out by changing the residence time at 15 volts to 420 seconds, with which a deep green color was obtained.

The above examples show that, by the use of the method in accordance with the present invention, a great variety of colors may be obtained without the need of changing the electrocoloring bath and that the different colors thus obtained largely depend on the structure of the innermost anodic layer and the thickness of the barrier layer. The remarkably different colors obtained in the above examples were produced by the mere change in the residence time during the last direct current treatment, which corresponds to the formation of the anodic layer which is next to the aluminum/aluminum oxide interface and therefore also to the formation of the barrier layer which is incorporated in said anodic layer.

EXAMPLE 8

A work piece of a 6063-T5 aluminum alloy was degreased and deoxidized in a 10% sulfuric acid solution also containing synthetic detergents for a period of time of 10 minutes. The work piece was rinsed with water and thereafter etched in a 7% sodium hydroxide solution at 60° C. for 15 minutes. The aluminum piece was then again rinsed with water and neutralized in a 17% sulfuric acid solution under stirring for 3 minutes and thereafter it was rinsed with water.

The thus cleansed and degreased work piece was then anodized in a solution containing 170 g/l sulfuric acid for 30 minutes at a temperature of 22° C. by the use of a direct current of 18 volts and using aluminum cathodes, whereby an anodic aluminum oxide layer of approximately 18 micron thickness was obtained, and the anodized piece was thoroughly rinsed with water.

The anodized piece was then immersed in an electrocoloring bath containing 3 g/l ferrous sulfate, 17 g/l sulfuric acid, 12 g/l 4-sulfophthalic acid and 0.03 g/l tannic acid at a temperature of 22° C. and using stainless steel counter-electrodes. Within said electrocoloring bath, the anodized work piece was subjected to the following electrolytical sequence:

a) A direct current stage comprising a voltage ramp growing from 0 to 14 volts in 30 seconds and then a voltage ramp decreasing from 14 volts to 10 volts in 60 seconds; followed by b) An alternating current stage comprising a voltage ramp growing from 0 to 5 volts in 5 seconds and remaining at 5 volts for the next 30 seconds and then a voltage ramp decreasing from 5 to 2 volts in 90 seconds and remaining at 2 volts for the next 200 seconds; followed by c) A direct current stage comprising a ramp growing from 0 to 8 volts in 20 seconds and remaining at 8 volts for the next 90 seconds; followed by d) An alternating current stage comprising a ramp growing from 0 to 16 volts in 30 seconds and remaining at 16 volts for the next 180 seconds.

The fully anodized work piece of aluminum alloy treated under the above sequence showed a grey color, which was duly preserved by rinsing the work piece with water and sealing the anodic film in boiling water containing 2 g/l nickel acetate for a period of time of 30 minutes.

EXAMPLE 9

The method described in Example 8 was repeated, with the only exception that step (c) of the electrolytical sequence was carried out by using a direct current stage comprising a ramp growing from 0 to 10 volts in 25 seconds and remaining at 10 volts for the next 120 seconds, whereby a blue color was obtained.

EXAMPLE 10

The method described in Example 8 was repeated, with the only exception that step (c) of the electrolytical sequence was carried out by using a direct current stage comprising a ramp growing from 0 to 13 volts in 25 seconds and remaining at 13 volts for the next 120 seconds, whereby a green color was obtained.

EXAMPLE 11

The method described in Example B was repeated, with the only exception that step (c) of the electrolytical sequence was carried out by using a direct current stage comprising a ramp growing from 0 to 15 volts in 25 seconds and remaining at 13 volts for the next 180 seconds, whereby an orange color was obtained.

EXAMPLE 12

The method described in Example 8 was repeated, with the only exception that step (c) of the electrolytical sequence was carried out by using a direct current stage comprising a ramp growing from 0 to 17 volts in 25 seconds and remaining at 17 volts for the next 180 seconds, whereby a brown color was obtained.

EXAMPLE 13

The method described in Example 8 was repeated, with the only exception that step (c) of the electrolytical sequence was carried out by using a direct current stage comprising a ramp growing from 0 to 19 volts in 30 seconds and remaining at 19 volts for the next 200 seconds, whereby a purple color was obtained.

The above examples 8 to 13 show that a broad range of colors can also be obtained by varying the voltage conditions under which the direct current treatment is effected, either alone or in combination with changes in the rime of residence of the work piece within the electrocoloring bath.

The following additional examples are presented in order to more fully illustrate the versatility of the method of the present invention, as to its capability of producing the full range of colors in the visible spectrum through the use of the same electrocoloring bath with changing electrical conditions or by the use of different electrocoloring baths for more easily producing special colors.

EXAMPLE 14

A sheet of aluminum metal 99.5% pure was degreased and deoxidized in a 15% sulfuric acid solution for a period of time of 15 minutes. The sheet was rinsed with water and thereafter etched in a 5% sodium hydroxide solution at 60° C. for 15 minutes. The aluminum sheet was then again rinsed with water and neutralized in a 5% nitric acid solution at room temperature for 10 minutes.

The thus cleansed and degreased aluminum sheet was then anodized in a solution containing 165 g/l sulfuric acid and 5 g/l aluminum metal for 30 minutes at a temperature of 24° C. under a direct current of 16 volts, whereby an anodic aluminum oxide layer of approximately 12 micron thickness was obtained, and the anodized sheet was thoroughly rinsed with water.

The anodized aluminum sheet was then immersed in an electrocoloring bath containing 15 g/l stannous sulfate, 18 g/l sulfuric acid and 8 g/l benzene sulfonic acid at a temperature of 20° C. and using stainless steel counter-electrodes. Within said electrocoloring bath, the anodized aluminum sheet was subjected to the following electrolytical sequence:

a) A direct current stage comprising a voltage ramp growing from 0 to 19.5 volts in 50 seconds and remaining constant at 19.5 volts for the next 30 seconds; followed by b) An alternating current stage comprising a voltage ramp growing from 0 to 6.1 volts in 15 seconds and remaining constant at 6.1 volts for the next 60 seconds and then a voltage ramp decreasing from 6.1 to 1.9 volts in 30 seconds and remaining constant at 1.9 volts for the next 200 seconds; followed by c) A direct current stage comprising a voltage ramp growing from 0 to 15 volts in 30 seconds and remaining at 15 volts for the next 80 seconds; followed by d) An alternating current stage comprising a voltage ramp growing from 0 to 16 volts in 30 seconds and remaining constant at 16 volts for the next 180 seconds.

The fully anodized aluminum sheet treated under the above sequence showed a deep grayish blue color, which was duly preserved by sealing the anodic film in a solution containing 5 g/l nickel acetate and 1 g/l cobalt acetate in deionized water under a pH of 5.85 and a temperature of 92° C. for a period of time of 30 minutes.

EXAMPLE 15

A profile of 6063-T5 aluminum alloy was degreased in a 25% sodium carbonate solution at 60° C. for a period of time of 10 minutes. The sheet was rinsed with water and thereafter etched in a 7% sodium hydroxide solution at 55° C., for 12 minutes. The aluminum alloy profile was then again rinsed with water and neutralized in a 5% nitric acid solution at room temperature for 10 minutes.

The thus cleansed and degreased aluminum alloy profile was then anodized in a solution containing 200 g/l sulfuric acid for 30 minutes at a temperature of 20° C. under a direct current of 15 volts, whereby an anodic aluminum oxide layer of approximately 14 micron thickness was obtained, and the anodized profile was thoroughly rinsed with water.

The anodized aluminum alloy profile was then immersed in an electrocoloring bath containing 10 g/l stannous sulfate, 18 g/l sulfuric acid and 3 g/l phenol sulfonic acid in deionized water at a temperature of 20° C. and using stainless steel counter-electrodes. Within said electrocoloring bath, the anodized aluminum sheet was subjected to the following electrolytical sequence:

a) A direct current stage comprising a voltage ramp growing from 0 to 15 volts in 30 seconds and remaining constant at 15 volts for the next 15 seconds; followed by b) An alternating current stage comprising a voltage ramp growing from 0 to 5 volts in 15 seconds and remaining constant at 5 volts for the next 30 seconds and then a voltage ramp decreasing from 5 to 2 volts in 30 seconds and remaining constant at 2 volts for the next 250 seconds, followed by c) A direct current stage comprising a voltage ramp growing from 0 to 18 volts in 30 seconds and remaining constant at 18 volts for the next 120 seconds; followed by d) An alternating current stage comprising a voltage ramp growing from 0 to 16 volts in 30 seconds and remaining constant at 16 volts for the next 180 seconds.

The fully anodized aluminum alloy profile treated under the above sequence showed a pistachio green color, which was duly preserved by sealing the anodic film in a solution containing 5 g/l nickel acetate and 1 g/l cobalt acetate in deionized water under a pH of 5.85 and a temperature of 92° C. for a period of time of 30 minutes.

EXAMPLE 16

A profile of a 6063-T5 aluminum alloy was degreased, etched, neutralized and anodized as described in Example 15 above.

The anodized piece was then immersed in an electrocoloring bath containing 30 g/l cobalt sulfate, 40 g/l magnesium sulfate and 15 g/l sulfuric acid in deionized water, at a temperature of 20° C. and using carbon counter-electrodes. Within said electrocoloring bath, the anodized aluminum profile was subjected to the following electrolytical sequence:

a) A direct current stage comprising a voltage ramp growing from 0 to 14 volts in 30 seconds and remaining constant at 14 volts for the next 15 seconds; followed by b) An alternating current stage comprising a voltage ramp growing from 0 to 5 volts in 15 seconds and remaining constant at 5 volts for the next 30 seconds and then a voltage ramp decreasing from 5 to 1.9 volts in 30 seconds and remaining constant at 1.9 volts for the next 300 seconds; followed by c) A direct current stage comprising a ramp growing from 0 to 17 volts in 30 seconds and remaining constant at 17 volts for the next 200 seconds; followed by d) An alternating current stage comprising a ramp growing from 0 to 16 volts in 30 seconds and remaining constant at 16 volts for the next 180 seconds.

The fully anodized profile of aluminum alloy treated under the above sequence showed a bright orange color, which was duly preserved also as described in Example 15.

EXAMPLE 17

Example 16 was repeated, with the only exception that stage (c) of the electrolytical sequence was changed as follows:

d) A direct current stage comprising a ramp growing from 0 to 17 volts in 30 seconds and remaining constant at 17 volts for the next 140 seconds.

The profile of aluminum alloy treated with this modified direct current stage showed a yellow color.

EXAMPLE 18

A profile of a 6061-T5 aluminum alloy was degreased, etched, neutralized and anodized as described in Example 15 above.

The anodized piece was then immersed in an electrocoloring bath containing 5 g/l copper sulfate and 15 g/l sulfuric acid in deionized water, at a temperature of 22° C. and using 304 stainless steel alloy counter-electrodes. Within said electrocoloring bath, the anodized aluminum profile was subjected to the following electrolytical sequence:

a) A direct current stage comprising a voltage ramp growing from 0 to 18 volts in 30 seconds and remaining constant at 18 volts for the next 10 seconds and then a voltage ramp decreasing from 18 to 11 volts in 60 seconds and remaining constant at 11 volts for the next 60 seconds; followed by b) An alternating current stage comprising a voltage ramp growing from 0 to 5 volts in 15 seconds and remaining constant at 5 volts for the next 120 seconds and then a voltage ramp decreasing from 5 to 1.8 volts in 30 seconds and remaining constant at 1.8 volts for the next 250 seconds; followed by c) A direct current stage comprising a ramp growing from 0 to 17 volts in 30 seconds and remaining constant at 17 volts for the next 60 seconds and then a voltage ramp decreasing from 17 to 14 volts in 15 seconds and remaining constant at 14 volts for the next 300 seconds; followed by d) An alternating current stage comprising a ramp growing from 0 to 16 volts in 30 seconds and remaining constant at 16 volts for the next 180 seconds.

The fully anodized profile of aluminum alloy treated under the above sequence showed a purple color, which was duly preserved also as described in Example 15.

EXAMPLE 19

An aluminum strap having a purity of 99.5% was mechanically polished until a mirror luster was obtained and then degreased in a slightly alkaline sodium carbonate solution containing synthetic detergents to prevent any loss of the luster at 60° C. The strap was then rinsed with water and thereafter anodized in a solution containing 150 g/l sulfuric acid and 10 g/l aluminum metal for 20 minutes at a temperature of 18° C. under a direct current of 15 volts, whereby an anodic aluminum oxide layer of approximately 10 micron thickness was obtained, and the anodized strap was thoroughly rinsed with water.

The anodized aluminum strap was then immersed in an electrocoloring bath containing 30 g/l nickel sulfate, 8 g/l stannous sulfate and 18 g/l sulfuric acid in deionized water at a temperature of 20° C. and using 316 stainless steel counter-electrodes. Within said electrocoloring bath, the anodized aluminum strap was subjected to the following electrolytical sequence:

a) A direct current stage comprising a voltage ramp growing from 0 to 20 volts in 15 seconds and remaining constant at 20 volts for the next 15 seconds; followed by b) An alternating current stage comprising a voltage ramp growing from 0 to 5.8 volts in 15 seconds and remaining constant at 5.8 volts for the next 60 seconds and then a voltage ramp decreasing from 5.8 to 2.1 volts in 30 seconds and remaining constant at 2.1 volts for the next 300 seconds; followed by c) A direct current stage comprising a voltage ramp growing from 0 to 12 volts in 30 seconds and remaining constant at 12 volts for the next 380 seconds; followed by d) An alternating current stage comprising a voltage ramp growing from 0 to 16.5 volts in 30 seconds and remaining constant at 16.5 volts for the next 180 seconds.

The fully anodized aluminum strap treated under the above sequence showed a bright and deep green color, which was duly preserved by sealing the anodic film as described in Example 15 above.

EXAMPLE 20

An aluminum strap made of 6063-T5 aluminum alloy was mechanically polished until a mirror luster was obtained and then degreased in a neutral solution containing synthetic detergents to prevent any loss of the luster at 60° C. The strap was then rinsed with water and thereafter anodized in a solution containing 140 g/l sulfuric acid and 3 g/l aluminum metal for 30 minutes at a temperature of 20° C. under a direct current of 17 volts, whereby an anodic aluminum oxide layer of approximately 16 micron thickness was obtained, and the anodized strap was thoroughly rinsed with water.

The anodized aluminum strap was then immersed in an electrocoloring bath containing 10 g/l stannous sulfate, 18 g/l sulfuric acid and 12 g/l tartaric acid in deionized water at a temperature of 22° C. and using tin metal counter-electrodes. Within said electrocoloring bath, the anodized aluminum strap was subjected to the following electrolytical sequence:

a) A direct current stage comprising a voltage ramp growing from 0 to 12 volts in 15 seconds and remaining constant at 12 volts for the next 120 seconds; followed by b) An alternating current stage comprising a voltage ramp growing from 0 to 3.1 volts in 5 seconds and remaining constant at 3.1 volts for the next 90 seconds and then a voltage ramp decreasing from 3.1 to 1.8 volts in 10 seconds and remaining constant at 1.8 volts for the next 260 seconds; followed by c) A direct current stage comprising a voltage ramp growing from 0 to 14 volts in 20 seconds and remaining constant at 14 volts for the next 70 seconds; followed by d) An alternating current stage comprising a voltage ramp growing from 0 to 16.5 volts in 30 seconds and remaining constant at 16.5 volts for the next 180 seconds.

The fully anodized aluminum strap treated under the above sequence showed a bright gray color, which was duly preserved by thoroughly rinsing the strap with water and sealing the anodic film in a solution of 3 g/l nickel acetate and 0.5 g/l cobalt acetate in deionized water at a temperature of 92° C. for a period of time of 30 minutes.

EXAMPLE 21

Example 19 was repeated, but a further stage was added to the electrolytical sequence described in said Example in order to illustrate the possibilities of controlling the intensity of the colors obtained by the method of the present invention by means of a fine scale adjustment.

Prior to the final sealing of the bright and deep green strap, a final direct current treatment of 19 volts for 80 seconds was applied to the strap to reduce the intensity of the final color by redissolving the inorganic materials deposited in stage (d) from the electrocoloring bath. This treatment provided a fine scale adjustment of the amount of inorganic material deposits. The final aluminum strap showed a medium-light green color without loosing its shiny appearance.

From the above it may be seen that the method of electrocoloring anodized aluminum substrates in accordance with the present invention, by the provision of at least three superposed anodic layers of aluminum oxide having different porosities, for the first time permits the production of a full range of colors within the visible spectrum, without the need of changing the electrocoloring bath.

As the different colors obtained by the method the present invention fully rely on predetermined changes in the electrical and time conditions used, and not on the chemical characteristics of the electrocoloring bath, since as it has been shown above many different colors can be produced within the same electrocoloring bath, it has been made possible for the first time to insert, in a data processing equipment, different programs representing the different electrolytical and time sequences necessary for each different color to be obtained in a predetermined electrocoloring bath, whereby a remarkably simplified procedure is possible, consisting in the mere selection of the desired program, thus letting the full method to be automatically operated by the data processor, in order to secure a most accurate reproducibility of the colors for different lots of pieces, for example, when a considerable number of said pieces is necessary for architectural applications and the like.

The method according to the present invention also provides a novel product consisting of an aluminum-based substrate having a stratified anodic aluminum oxide film comprising at least three superposed porous anodic aluminum oxide layers, each having a different porosity and a different density, and deposits of pigmentary inorganic material within the pores of said layers for producing a predetermined color by light interference and differential refraction between the inorganic materials in the pores of the layers and the aluminum/aluminum oxide interface between the anodic film and the aluminum-based substrate.

Although certain specific embodiments of the present invention have been shown and described above, it is to be understood that many modifications thereof are possible. The present invention, therefore, is not to be restricted except insofar as is necessitated by the prior art and by the scope and spirit of the appended claims.

What is claimed is:

1. A colored anodized aluminum product comprising an aluminum-based substrate, an aluminum oxide anodic film over the surface of said substrate and an intermediate aluminum/aluminum oxide interface therebetween, said aluminum oxide anodic film comprising at least three superimposed aluminum oxide anodic porous layers each having a plurality of pores that are different from the pores of the other layers, an interface being formed between each consecutive pair of said at least three superimposed aluminum oxide anodic porous layers, a barrier layer of non-porous aluminum oxide located between the bottom of the pores of the innermost one of said at least three aluminum oxide anodic layers and the aluminum/aluminum oxide interface, and deposits of a pigmentary inorganic material within the pores of said at least three superimposed aluminum oxide anodic layers and in at least portions of the interfaces between said layers.

2. A colored anodized aluminum product according to claim 1 wherein said at least three aluminum oxide anodic layers comprise an outer layer having evenly distributed pores with diameters of between about 150 Å and about 180 Å (15–18 nm) spaced apart by walls of approximately the same thickness, an intermediate layer having pores having diameters and spacing intermediate walls smaller than those of the outer layer, and an inner layer having diameters similar to those of the pores of the intermediate layer but spaced apart by walls that are thicker than those of the said intermediate layer, said pores of the inner layer having lengths that are shorter than the thickness of the layer in order to form a non porous barrier layer between the bottom of said pores and the aluminum/aluminum oxide interface.

3. A colored anodized aluminum product according to claim 1 wherein said deposits of pigmentary inorganic material are deposits of a metal selected from the group consisting of tin, copper, iron, cobalt, nickel, silver, cadmium, lead, manganese, molybdenum and the like.

4. A colored anodized aluminum product according to claim 3 wherein said metal is tin.

5. A method for electrocoloring an anodized aluminum product comprising the steps of:

a) anodizing an aluminum-based substrate by immersing the same as an anode into an electrolytic bath containing sulfuric acid and passing a direct current through said bath between said anode and a metal counter-electrode in order to form a first porous aluminum oxide anodic layer having a non porous barrier layer between the bottom of the pores and the aluminum/aluminum oxide interface;

b) cleaning the inner surfaces of the pores of said first porous aluminum oxide anodic layer and reducing the thickness of said barrier layer until reaching a desired thickness by treating the thus obtained anodized aluminum-based substrate in an electrocoloring bath containing sulfuric acid at a concentration lower than the concentration of the bath used in step (a) and at least one pigmentary metal salt, under direct current conditions, in order to dissolve the bottoms of the pores by current-assisted dissolution until the barrier layer is reduced to the desired thickness;

c) electrolytically treating the anodized substrate within the same electrocoloring bath used in step (b) under alternating current conditions in order to form a second porous aluminum oxide anodic layer under the first anodic layer, said second anodic layer having finer pores than the first anodic layer;

d) electrolytically treating the thus obtained product within the same electrocoloring bath used in step (b) under direct current conditions in order to form a third porous aluminum oxide anodic layer under the second anodic layer, said third anodic layer having fine pores with thicker walls than the pores of the second anodic layer; and e) electrolytically depositing pigmentary metals within the pores of said first, second and third porous aluminum oxide anodic layers and at least on portions of the interfaces between said layers within the same electrocoloring bath used in step (b) under alternating current conditions at higher voltages than in step (c) in order to prevent formation of additional anodic layers.

6. A method according to claim 5 wherein said metal salt is a salt of a metal selected from the group comprising tin, copper, iron, cobalt, nickel, silver, cadmium, lead, manganese and molybdenum.

7. A method according to claim 6 wherein said metal salt is a tin salt.

8. A method according to claim 7 wherein said tin salt is stannous sulfate.

9. A method according to claim 8 wherein said electrocoloring bath additionally contains a reducing acid.

10. A method according to claim 9 wherein said reducing acid is selected from tannic acid, tartaric acid, citric acid, sulfamic acid, glycolic acid, malonic acid, oxalic acid, boric acid and mixtures thereof.

11. A method according to claim 10 wherein said reducing acid is tannic acid.

12. A method according to claim 5 wherein step (c) is carried out by using an alternating current of less than 15 volts, and step (d) is carried out by using a direct current of from about 15 to about 25 volts.

13. A method according to claim 5 wherein step (d) is carried out under a direct current of not more than about 25 volts and for a period of time of from about 1 minute to about 10 minutes, depending on the color desired for the aluminum-based anodized product.

14. A method for electrocoloring an anodized aluminum product comprising the steps of:

a) anodizing an aluminum-based substrate by immersing the same as an anode into an electrolytic bath containing sulfuric acid and passing a direct current through said bath between said anode and a metal counter-electrode in order to form a first porous aluminum oxide anodic layer having a non porous barrier layer between the bottom of the pores and the aluminum/aluminum oxide interface;

b) cleaning the inner surfaces of the pores of said first porous aluminum oxide anodic layer and reducing the thickness of said barrier layer until reaching a desired thickness by treating the thus obtained anodized aluminum-based substrate in an electrolytic bath containing sulfuric acid at a concentration lower than the concentration of the bath used in step (a) and under direct current conditions, in order to dissolve the bottoms of the pores by current-assisted dissolution until the barrier layer is reduced to the desired thickness;

c) electrolytically treating the anodized substrate within the same electrolytic bath used in step (b) under alternating current conditions in order to deposit a second porous aluminum oxide anodic layer under the first anodic layer, said second anodic layer having finer pores than the first anodic layer;

d) electrolytically treating the thus obtained product within the same electrolytic bath used in step (b) under direct current conditions in order to deposit a third porous aluminum oxide anodic layer under the second anodic layer, said third anodic layer having fine pores with thicker walls than the pores of the second anodic layer; and e) electrolytically depositing pigmentary metals within the pores of said first, second and third porous aluminum oxide anodic layers and at least on portions of the interfaces between said layers from an electrocoloring bath containing sulfuric acid and at least a salt of one of said pigmentary metals under alternating current conditions at higher voltages than in step (c) in order to prevent formation of additional anodic layers.

15. A method according to claim 14 wherein said metal salt is a salt of a metal selected from the group comprising tin, copper, iron, cobalt, nickel, silver, cadmium, lead, manganese and molybdenum.

16. A method according to claim 15 wherein said metal salt is a tin salt.

17. A method according to claim 16 wherein said tin salt is stannous sulfate.

18. A method according to claim 17 wherein said electrocoloring bath additionally contains a reducing acid.

19. A method according to claim 18 wherein said reducing acid is selected from tannic acid, tartaric acid, citric acid, sulfamic acid, glycolic acid, malonic acid, oxalic acid, boric acid and mixtures thereof.

20. A method according to claim 19 wherein said reducing acid is tannic acid.

21. A method according to claim 14 wherein said electrocoloring bath additionally contains a sulfonated acid in order to reduce the dissolving power of the acid towards the aluminum oxide of the anodic layers.

22. A method according to claim 21 wherein said sulfonated acid is 4-sulfophthalic acid.

23. A method according to claim 14 wherein a final direct current is applied at a voltage of less than about 25 volts and for a short period of time after the electrolytic deposition of pigmentary metals to partially redissolve said pigmentary metal deposits and thus adjusting the final shade desired for the color.

24. A method according to claim 14 wherein step (c) is carried out by using an alternating current of less than 15 volts, and step (d) is carried out by using a direct current of from about 15 to about 25 volts.

25. A method according to claim 14 wherein step (d) is carried out under a direct current of not more than about 25 volts and for a period of time of from about 1 minute to about 10 minutes, depending on the color desired for the aluminum-based anodized product.

26. A method for electrocoloring an anodized aluminum product comprising the steps of:

a) anodizing an aluminum-based substrate by immersing the same as an anode into an electrolytic bath containing sulfuric acid and passing a direct current through said bath between said anode and a metal counter-electrode in order to form a first porous aluminum oxide anodic layer having a non porous barrier layer between the bottom of the pores and the aluminum/aluminum oxide interface;

b) cleaning the inner surfaces of the pores of said first porous aluminum oxide anodic layer and reducing the thickness of said barrier layer until reaching a desired thickness by treating the thus obtained anodized aluminum-based substrate in an electrolytic bath containing sulfuric acid at a concentration lower than the concentration of the bath used in step (a) and under direct current conditions, in order to dissolve the bottoms of the pores by current-assisted dissolution until the barrier layer is reduced to the desired thickness;

c) electrolytically treating the anodized substrate within the same electrolytic bath used in step (b) under alternating current conditions in order to deposit a second porous aluminum oxide anodic layer under the first anodic layer, said second anodic layer having finer pores than the first anodic layer;

d) electrolytically treating the thus obtained product within the same electrolytic bath used in step (b) under direct current conditions for a short period of time in order to deposit a third porous aluminum oxide anodic layer under the second anodic layer, said third anodic layer having fine pores with thicker walls than the pores of the second anodic layer;

e) repeating steps (c) and (d) as many times as desired to form additional pairs of superimposed anodic layers; and f) electrolytically depositing pigmentary metals within the pores of said first, second and third porous aluminum oxide anodic layers and at least on portions of the interfaces between said layers from an electrolytic bath containing sulfuric acid and at least a salt of one of said pigmentary metals under alternating current conditions at higher voltages than in step (c) in order to prevent formation of additional anodic layers.

27. A method according to claim 13 wherein different colors are produced by varying the time conditions in step (d).

28. A method according to claim 5 wherein different colors are produced by varying the current conditions in step (d).

29. A method according to claim 23 wherein different colors are produced by varying the time conditions in step (d).

30. A method according to claim 14 wherein different colors are produced by varying the current conditions in step (d).

31. A method according to claim 26 wherein different colors are produced by varying the time conditions in step (d).

32. A method according to claim 26 wherein different colors are produced by varying the current conditions in step (d).

33. A method according to claim 5 wherein said electrocoloring bath additionally contains a sulfonated acid in order to reduce the dissolving power of the acid towards the aluminum oxide of the anodic layers.

34. A method according to claim 33 wherein said sulfonated acid is 4-sulfophthalic acid.

35. A method according to claim 5 wherein a final direct current is applied at a voltage of less than about 25 volts and for a short period of time after the electrolytic deposition of pigmentary metals to partially redissolve said pigmentary metal deposits and thus adjusting the final shade desired for the color.

36. A method according to claim 12 wherein step (c) is carried out by using an alternating current of less than 7 volts, and step (d) is carried out by using a direct current of 16 volts.

37. A method according to claim 24 wherein step (c) is carried out by using an alternating current of less than 7 volts, and step (d) is carried out by using a direct current of 16 volts.

* * * * *